US005954423A

United States Patent [19]

Logan et al.

[11] Patent Number: 5,954,423

[45] Date of Patent: Sep. 21, 1999

[54] LIGHT DISTRIBUTION DIFFUSER FOR EXIT SIGNS AND THE LIKE ILLUMINATED BY LED ARRAYS

[75] Inventors: Mark Campbell Logan, Doraville; James Michael Lay, Grayson, both of Ga.

[73] Assignee: NSI Enterprises, Inc., Atlanta, Ga.

[21] Appl. No.: 08/850,493

[22] Filed: May 2, 1997

[51] Int. Cl.[6] ..... F21V 5/00

[52] U.S. Cl. ..... 362/235; 362/240; 362/246; 362/311; 362/812; 362/800; 362/355; 40/570

[58] Field of Search ..... 362/235, 249, 362/240, 244, 355, 812, 800, 311, 246; 40/570

[56] References Cited

U.S. PATENT DOCUMENTS

| | | | |
|---|---|---|---|
| 2,404,753 | 7/1946 | Siemers | 362/311 |
| 4,214,168 | 7/1980 | Kulka | 362/235 |
| 4,967,317 | 10/1990 | Plumly | 362/812 |
| 5,299,109 | 3/1994 | Grondal | 362/812 |
| 5,365,411 | 11/1994 | Rycroft et al. | 362/812 |

*Primary Examiner*—Thomas M. Sember
*Attorney, Agent, or Firm*—Kenneth E. Darnell

[57] ABSTRACT

A substantially transparent and preferably textured diffuser element disposed in surmounting relation to an array of light emitting diodes intended to illuminate a legend-bearing sign panel of an exit sign or similar illuminated sign, the invention allows compact sign enclosure formation and provides even illumination of sign panels on all legend-bearing face walls of the exit sign even though multiple point light sources such as light emitting diodes comprise the illumination source. The diffuser element of the invention is preferably embodied in a tent-shaped configuration with a plurality of apertures disposed along the apex of the diffuser element with one each of the apertures being disposed immediately above each light emitting diode. The preferred diffuser element of the invention is elongated in conformation and used with a linear array of light emitting diodes, the array being preferably located along at least one interior wall of the sign enclosure adjacent at least one of the legend-bearing face walls. The diffuser element is particularly useful with relatively non-diffuse, narrow-viewing angle light emitting diodes, the aperture in the diffuser element above each diode allowing substantial portions of the light emanating outwardly from free end portions of each diode to pass undiffused therethrough and into interior portions of the sign enclosure which are spaced from the LED array to illuminate portions of one or more sign panels spaced from the array. Light emanating from lower portions of the light emitting diodes at "flat" angles is diffused through the diffuser element into portions of the sign enclosure nearmost the LED array to illuminate portions of one or more sign panels adjacent the array.

19 Claims, 7 Drawing Sheets

LIGHT DISTRIBUTION DIFFUSER FOR EXIT SIGNS AND THE LIKE ILLUMINATED BY LED ARRAYS

BACKGROUND OF THE INVENTION

1. Field of the Invention

The invention relates generally to illuminated signs having multiple point light sources such as light emitting diode arrays as the illumination source for legend-bearing face panels and particularly to diffuser structure mountable in relation to such an array for facilitating an even distribution of light within such a sign to improve illumination of the typically translucent legend disposed on such a face panel.

2. Description of the Prior Art

Illuminated signs and particularly exit signs are commonly employed in commercial and industrial situations as well as in multi-unit residential buildings primarily for exit identification. Such signage takes many forms with interior illumination being provided through the use of a variety of illumination sources, an illumination source of particular utility in these energy conscious times being light emitting diodes which require greatly reduced power expenditures for operation. Although light emitting diodes have been used as the illumination source in exit signs and the like for well over twenty years, the use of light emitting diodes as the illumination source in an exit sign or the like continues to have negative aspects due primarily to the low level of illumination provided by a single diode. While developments in the production of light emitting diodes have continued over the years toward greater light-producing levels for these devices, it must still be recognized that LED technology has not improved to the present time to a point where only a few diodes could be employed with the lighting efficiency of, for example, only one or two incandescent or fluorescent lamps such as are also presently used in exit signage and the like. In order to overcome the low light generating capability of presently available light emitting diodes, various approaches have evolved including the use of a relatively large number of spaced apart light emitting diodes in various arrangements or arrays for providing the necessary candle power for satisfactory illumination of the interior of an exit sign such that the legends on face walls of such signs are evenly illuminated according to code requirements or any other reasonable standard of acceptability. In many such signs, light emitting diodes have been arranged in rows corresponding to the configuration of letters or numbers which comprise the legend of the sign. Such arrangements typically produce alternating bright spots and dark spots in the illuminated legend of the sign even when a diffuser material is placed between the light emitting diodes and the legend sheet or plate. The use of diffusing structure and of reflecting structure has also come into practice in efforts to more evenly distribute light within an exit enclosure so that a legend sheet or plate is more evenly illuminated and illuminated with sufficient candle power to provide an illuminated sign of satisfactory utility. As one example, Rycroft et al, in U.S. Pat. No. 5,365,411, provides diffusing structure in the form of coatings intended to diffuse light emanating from light emitting diodes prior to exit of the light from the sign enclosure through a translucent legend. In patents such as U.S. Pat. No. 5,276,591 to Hegarty, diffusing structure is provided to facilitate use of light emitting diodes and illumination sources in exit signs or the like wherein the diodes are placed to cause light from the diodes to take an indirect path through the translucent legend portion of a legend sheet or plate. In Hegarty, transparent or translucent plastic panels are employed which are edge-lit by linear arrays of light emitting diodes so that light injected into the edges of the plastic panels is reflected internally therewithin to diffuse the light and thereby to attempt the creation of an acceptable and even level of illumination within the sign enclosure.

The history of light emitting diode usage in exit signs has therefore been and continues to be an attempt to engineer the use of as few diodes as possible combined with diode mounting arrangements, reflector arrangements and diffuser arrangements inter alia which will provide an acceptable illumination level coupled with a desired even illumination within an acceptably compact sign enclosure structure. Recent trends toward placement of linear LED arrays along one or more interior perimetric walls of a sign enclosure has typically been accompanied by objectionable bands of differing brightness levels horizontally across the illuminated legend of such a sign, such signs so lit often failing to meet code requirements for visibility in addition to being aesthetically objectionable. Prior attempts to correct this particular problem have typically involved positioning of the LED array at greater distances outside of the extents of the translucent legend portions of the sign panel, thereby increasing size and cost of the sign enclosure.

The present invention intends improvement upon the prior art by provision of a volumetrically compact sign enclosure evenly illuminated throughout the interior of the enclosure by an array of light emitting diodes preferably disposed along one interior wall of the sign enclosure. Preferably, a linear array of a minimum number of light emitting diodes is disposed along the horizontal "floor" of the exit sign with the light emitting diodes being mounted to a substrate such as a printed circuit board and extending upwardly from the printed circuit board, which board is positioned immediately below the location of the translucent portions of the legend disposed in or on a sign panel or sheet of the exit sign. The invention particularly contemplates use of a diffuser element mounted above the LED array and being configured to scatter or diffuse light from the light emitting diodes near lower portions of the sign panel and to allow undiffused passage of light through at least portions of the diffuser and into portions of the sign enclosure located both medially of the enclosure and adjacent opposite wall portions of the enclosure. A desirable illumination level and evenness of illumination is therefore provided within the sign enclosure to evenly illuminate the sign legend at an acceptable level of brightness. The advances in the art afforded by the present invention are accompanied by a reduction in the number of light emitting diodes necessary to produce a given illumination level coupled with an ability to provide a compact sign enclosure, manufacturing costs of the exit enabled by the features of the invention thus being held to acceptable levels.

SUMMARY OF THE INVENTION

The invention provides a substantially transparent and preferably textured diffuser element intended for mounting within the interior of an exit sign or the like in spaced relation from and in surmounting relation to an array of light emitting diodes which are employed within the sign to illuminate a legend-bearing sign panel. A preferred embodiment of the invention takes the form of an elongated, tent-like diffuser element formable from a blank of a die-cut plastic film, the blank being bent along its longitudinal axis to produce a configuration comprised of elongated planar portions which are angled relative to each other to effectively form a dihedral angle. At spaced locations along the apex of the dihedral angle, openings are formed to receive support structure extending from a printed circuit board or similar substrate on which light emitting diodes are disposed in a linear array according to a preferred embodiment of the invention. Spaced apertures are formed one each along the apex of the diffuser and in alignment with one each of the light emitting diodes according to a preferred embodiment so that major portions of that light emanating from free end portions of the diodes can pass undiffused through said apertures in the diffuser and into interior portions of the exit sign enclosure. Essentially, the light passing through the apertures of the diffuser illuminate those portions of the sign enclosure which are spaced medially of the enclosure and also at the furthermost portions of the enclosure. Light emanating from lower portions of the light emitting diodes and which does not pass through the apertures is diffused by the texturing of the diffuser material into portions of the sign enclosure which are nearmost the LED array. The present diffuser structures act to provide even illumination within an exit sign enclosure by diffusing portions of the light emanating from the multiple point light sources of an LED array and by allowing other portions of the light to proceed unimpeded into interior portions of the sign enclosure spaced greater distances from the LED array.

The diffuser structures of the invention find particular use with relatively non-diffuse, narrow-viewing angle light emitting diodes. Examples of such diodes include a "blue" light emitting diode manufactured by Nichia Chemical Industries, Ltd., of Tokyo, Japan, these diodes being particularly useful for production of a green legend as viewed from exteriorly of the illuminated sign. When "blue" light emitting diodes are employed, a diffusion panel including a transformation material, is utilized as is taught in copending U.S. patent application Ser. No. 08/471,830, filed Jun. 7, 1995, entitled Lighting Fixtures, and assigned to the present assignee, the disclosure of which is incorporated hereinto by reference. Through use of the present diffuser structure, high illumination levels of a desirable color are produced within the interior of a sign enclosure by light emitting diodes of differing color and type and which are commonly available.

Use of the diffuser structures of the invention allows production of an exit sign enclosure of compact configuration within which desirably bright and even levels of illumination produce an aesthetically acceptable legend illumination as viewed from a usual location in an environmental space of a building. The diffuser structures of the invention therefore enable the production of an exit sign of a desirable size and cost and which is capable of exceptional performance. The diffuser structures of the invention are susceptible to manufacture with relative ease due to structural simplicity, cost of the diffuser structures of the invention also being minimized due to the low cost of the material employed for formation of said diffuser structures.

Accordingly, it is an object of the invention to provide a diffuser structure usable within the interior of an illuminated sign such as an exit sign or the like to improve illumination of at least one legend-bearing sign panel of the sign.

It is another object of the invention to provide a substantially transparent and preferably textured diffuser structure used in association with an array of light emitting diodes or similar multiple point light sources for illumination of a legend-bearing sign panel of an exit sign or similar illuminated sign.

It is a further object of the invention to provide a diffuser element usable with an array of light emitting diodes for illumination of a legend-bearing sign panel in an exit sign or similar illuminated sign wherein portions of the diffuser structure are open to allow portions of the light emanating from the light emitting diodes to pass undiffused through the diffuser structure and into portions of the sign enclosure removed from the LED array while light emanating from other portions of the light emitting diodes is diffused into portions of the sign enclosure nearmost the LED array to illuminate those portions of one or more sign panels adjacent the array, thereby to provide an acceptably bright and even illumination of a translucent legend formed in said sign panel or panels.

Further objects and advantages of the invention will become more readily apparent in light of the following detailed description of the preferred embodiments.

DESCRIPTION OF THE PREFERRED EMBODIMENT

Figure 1A:
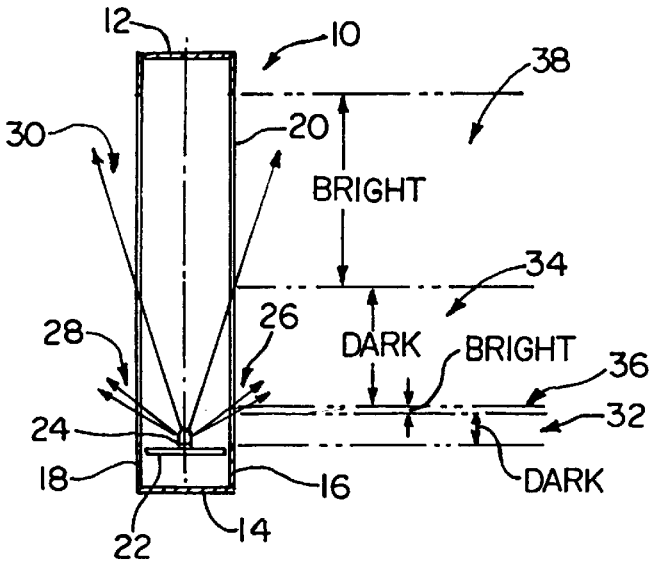
FIG. 1A PRIOR ART
FIG. 1A is a side elevational view of a prior art exit sign utilizing a linear light emitting diode array and illustrating uneven lighting performance typical of the prior art utilizing such an array.
Figure 1B:
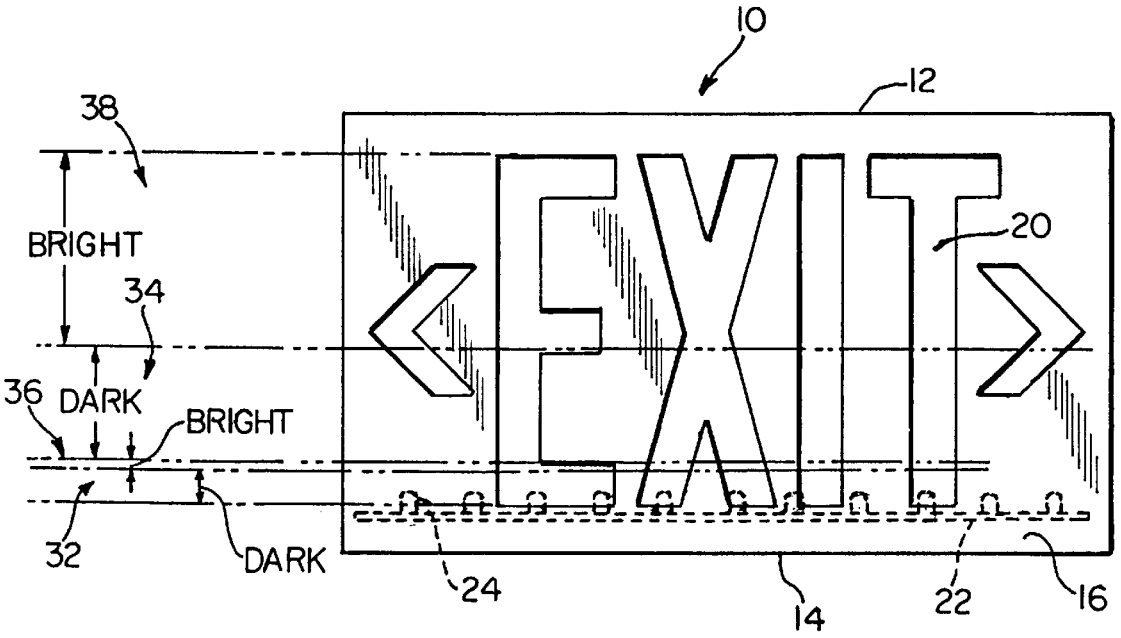
FIG. 1B PRIOR ART
FIG. 1B is a prior art illustration of the exit sign of FIG. 1A seen as a front elevational view and showing uneven light distribution patterns typical of prior art exit signs so configured.

Prior to a description of the preferred embodiments of the invention, a particular problem of the prior art successfully addressed by the present invention can be understood by reference to FIGS. 1A and 1B which illustrate schematically zones of differing illumination in a legend of an illuminated sign such as an exit sign and which typically occur when a light emitting diode array and particularly a linear light emitting diode array is disposed at an interior perimeter surface of an exit sign enclosure such as the "floor" of such an enclosure. With reference to FIGS. 1A and 1B, a prior art exit sign is seen generally at 10 to include top and bottom walls 12 and 14 respectively with legend-bearing wall panels 16 and 18 respectively comprising major planar face portions of the sign 10 between the top wall 12 and the bottom wall 14. Legend 20 takes the form of letters spelling the word "EXIT" and chevrons disposed on either side of the letters. The legend 20 conventionally takes the form of openings formed in the wall panels 16 and 18. It is to be understood that only one of the legend-bearing panels 16 or 18 would be utilized in the event that the exit sign 10 is to have only one panel intended to be visible such as in a direct mounting of the sign 10 to a wall or the like.

In the prior art exit sign 10, a substrate 22 which can take the form of a printed circuit board or similar dimensionally stable material is disposed within the interior of the exit sign 10 and in spaced relation to interior wall surfaces of the bottom wall 14 by mounting structure which is not shown for convenience. The substrate 22 mounts a plurality of light emitting diodes 24 in a linear array, the diodes 24 being conventionally connected together in a series and/or parallel circuit arrangement. In the prior art, it has been recognized that the substrate 22 bearing the light emitting diodes 24 should be mounted immediately below the lowermost extent of the legend 20 formed in the wall panels 16, 18. By so mounting the substrate 22 and array of the diodes 24, the physical size of the framing structure comprising the exit sign 10 can be as compact as possible. However, especially when the diodes 24 are of the relatively non-diffuse, narrow-viewing angle type, the light generating capabilities of the diodes 24 cause significant portions of the light emanating from said diodes 24 to lie within side angles 26 and 28 and top angle 30, thereby producing relatively dark zones 32 and 34 disposed respectively along lower portions of the legend 20 and along medial portions of the legend 20 somewhat below a center line extending longitudinally of the length of the sign 10. Further, relatively bright zones 36 and 38 are produced in the legend 20 where the side angles 26, 28 and oppositely disposed rays of the top angle 30 intersect the legend 20 on the panels 16, 18. These zones of alternating bright and dark areas are aesthetically objectionable and can cause an exit sign 10 in particular to fail code requirements for visibility.

While the exit sign 10 is schematically shown without use of a diffuser panel or sheet disposed over interior wall surfaces on the wall panels 16, 18, the provision of such diffusion panels does not operate to improve upon the objectionable zones 32, 34 and 36, 38 of alternating illumination levels. Typical prior art efforts to improve the exit sign 10 involve positioning of the light emitting diodes 24 at locations far outside the extents of the legend 20 on the panels 16, 18, thereby causing the size and cost of the sign enclosure to increase with only modest success in improvement of consistency of legend illumination.

As noted briefly above, the problem illustrated in FIGS. 1A and 1B is particularly acute when the light emitting diodes 24 are diodes known as non-diffuse, narrow-viewing angle diodes. Use of such non-diffuse, narrow-viewing angle light emitting diodes is particularly problematic when the enclosure forming the exit sign 10 is exceptionally "shallow" or thin relative to the length and height of the exit sign, that is, when the exit sign 10 has dimensions which are referred to in the industry as a "low profile" exit sign as is desirable in many use situations. It is also to be noted that light distribution problems arise within an illuminated sign such as the exit sign 10 when the diodes 24 are other than the non-diffuse, narrow-viewing angle type. In such situations, the present invention also finds utility in its ability to diffuse much of the brightest light produced by the diodes 24 to the legend 20 while allowing at least some light to illuminate upper portions of the sign 10.

Figure 2:
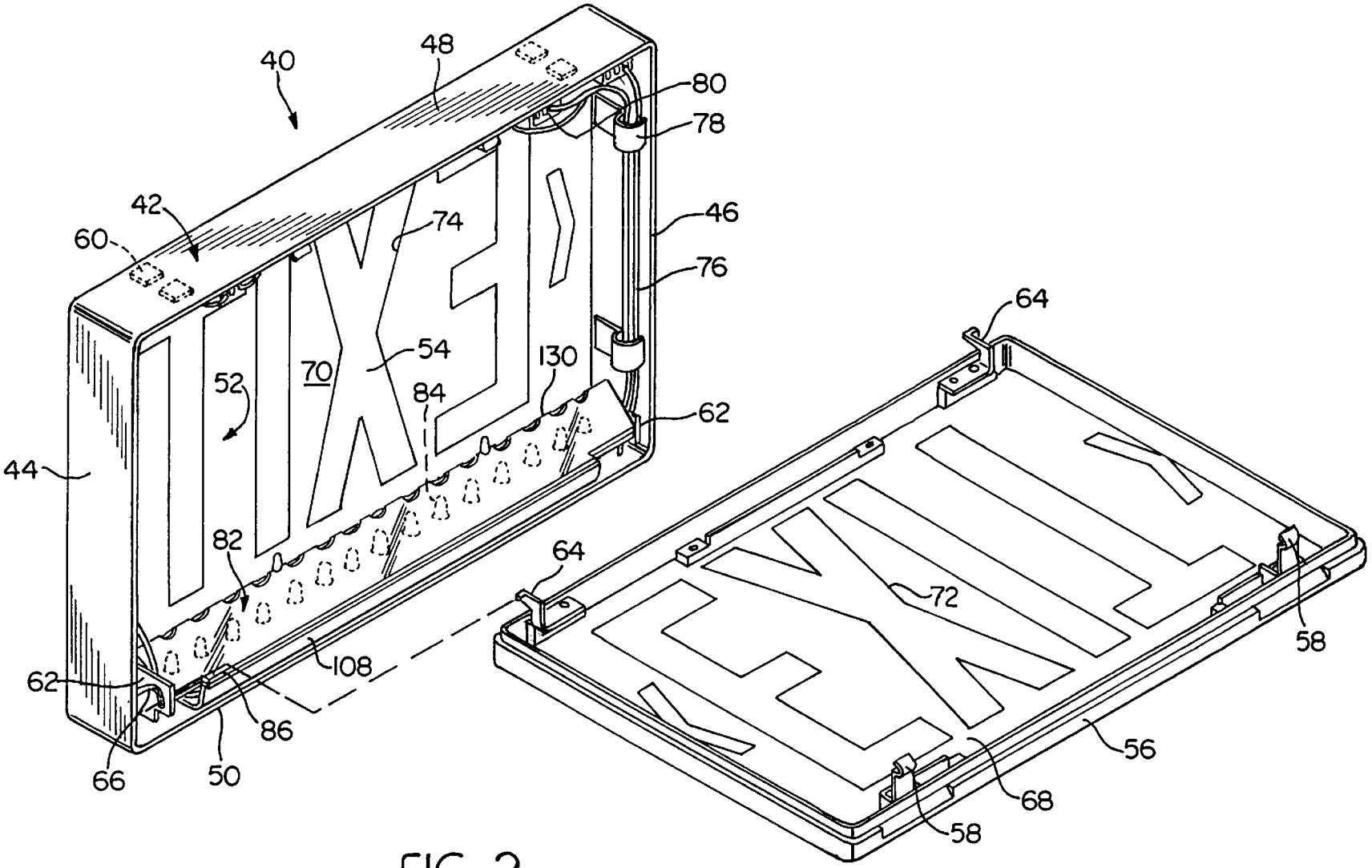
FIG. 2 is a perspective view of an exit sign including a metal die-cast enclosure having a facing panel removed therefrom to illustrate a light emitting diode array and mounting arrangement surmounted by a diffuser structure according to the invention, the array and diffuser structure being illustrated in a preferred location within the interior of the exit sign enclosure.
Figure 3:
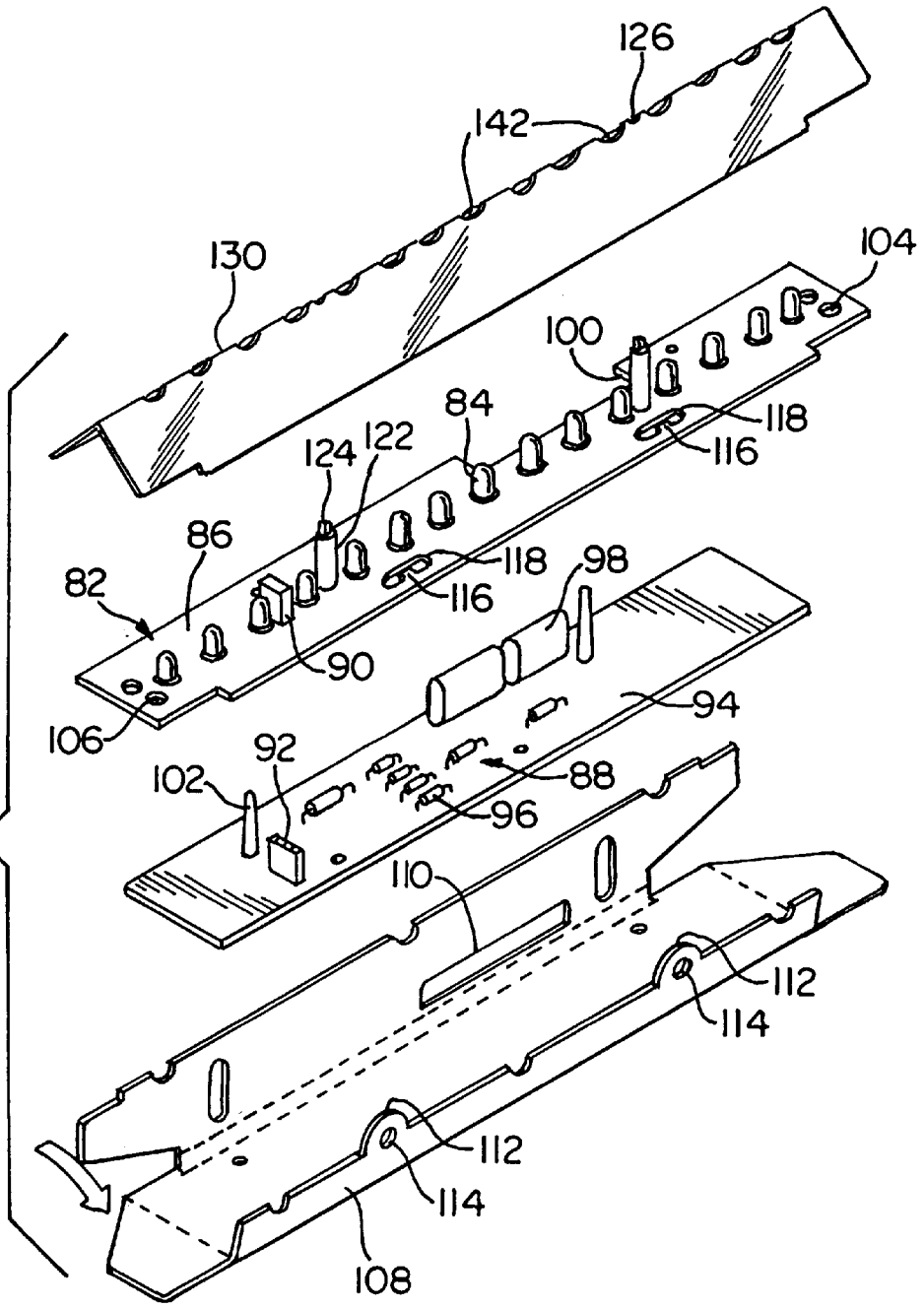
FIG. 3 is an exploded view of the linear light emitting diode array and mounting arrangement of FIG. 2 shown removed from the exit sign enclosure and illustrated in an exploded, assembly view relative to a preferred embodiment of the diffuser structure of the invention.

Referring now to FIGS. 2 through 7 generally and particularly to FIGS. 2 and 3, an exit sign 40 improved according to the invention is seen to comprise an enclosing frame 42 formed of side walls 44 and 46, a top wall 48 and a bottom wall 50. A planar back wall 52 can be integrally formed as a part of the enclosing frame 42 and can conventionally be formed as a solid plate or as a wall having openings which form a legend 54. A front wall panel 56 is conventionally mounted to the enclosing frame 42 for rapid snap-fitting to the enclosure 42 by means of spring snaps 58 which cooperate with fixed snap lugs 60 (seen in phantom) formed on interior surfaces of the top wall 48 in a conventional manner to snap-fit the front wall panel 56 to the enclosing frame 42. The front wall panel 56 pivots along a bottom edge thereof relative to an edge of the bottom wall 50 of the frame 42 through use of conventional brackets 62 fixed to interior surfaces of the bottom wall 50 at either end thereof and cooperating followers 64 mounted to the front wall panel, each follower 64 following a curved track 66 formed in each of the brackets 62 to allow pivoting motion of the front wall panel 56 relative to the enclosing frame 42 and further allowing the front wall panel 56 to be readily removed from the frame 42 and pivoted back onto the frame 42 as is conventional in the art. The enclosing frame 42 and the front wall panel 56 which effectively comprise the housing of the exit sign 40 can be formed of a variety of materials including die-cast metal and can be formed with decorative surfaces. In the exit sign 40 illustrated, the frame 42 and the panel 56 are formed of aluminum with the outer perimeter of the frame 42 and side perimetric edges of the panel 56 being painted black while facing surfaces of the back wall 52 and of the front wall panel 56 are brushed aluminum in order to provide a desired appearance. Sign panels 68 and 70 are respectively fixed in place over the legend 54 of the back wall 52 and legend 72 formed in the front wall panel 56 as is also conventional in the art. It should be understood that the sign panel 70 would not be used in a modification of the exit sign 40 wherein the legend 54 would not be formed in the back wall 52.

As is also conventional in the art, the legends 54 and 72 essentially comprise openings in planar wall faces of the back wall 52 and the front wall panel 56 respectively. As is also conventional in the art, inner facing surfaces of the sign panels 66 and 68 can be covered with a layer of opaque material such as the layer 74, in order to cover those portions of said panel 68, 70 which are not immediately behind the respective legends 54, 72.

The exit sign 40 as shown is of a kind referred to as a "standard" exit sign which is not operable in the event of failure of standard mains power. The illumination source of the exit sign 40 is operated on AC current through wiring 76 brought into the interior of the sign 40 through a mounting structure (not shown), the wiring 76 connecting circuitry internally of the exit sign 40 to AC mains power. As is also conventional in the art, wire management devices 78 are provided within the interior of the sign 40 to prevent the wiring 76 from inadvertently extending into the interior of the sign enclosure to "shadow" either of the legends 54 or 72. Wire nuts 80 and similar electrical connecting structure can be provided internally of the exit 40 to facilitate electrical operation of the sign 40.

Interior wall surfaces of the exit sign 40 are preferably coated with a reflective material such as white paint, the layer 74 of opaque material formed on the sign panels 68, 70 also preferably being reflective. This reflectivity may be gained by the simple expedient of a coloring of the layer 74 to be a reflective color such as white. Mounting of the exit sign 40 to a structural surface of a building is conventionally accomplished through the top wall 48 or one of the side walls 44, 46.

An array 82 of light emitting diodes 84 is mounted by a printed circuit board 86 in a conventional fashion, the diodes 84 being arrayed in a linear pattern essentially centered on the board 86 and centered within the sign 40 in that plane in which the board 86 lies. It is preferred that the plane of the board 86 be perpendicular to the respective planes within which the back wall 52 and the front wall panel 56 lie so that the diodes 84 are held in a favorable position for illumination of the sign 40. The diode-bearing board 86 is mounted at a location spaced from internal surfaces of the bottom wall 50, the plane of the board 86 being immediately below the lowermost extents of the legends 54, 72 respectively. It is important that the board 86 can be positioned immediately below the lowermost portions of the legends 54, 72 in order to provide not only a desired illumination level and evenness of illumination, but also a compact sign unit. The light emitting diodes 84 are preferably arranged in regularly spaced relation to each other and, for the exit sign 40 shown, the light emitting diodes 84 are seen to comprise non-diffuse, narrow-viewing angle diodes which can be "blue" diodes as referred to herein. The diodes 84 are mounted to the circuit board 86 in a conventional manner and connect to a circuit shown generally at 88 by means of respective mating electrical connectors 90 and 92, the connector 90 extending through the board 86 and the connector 92 being mounted to a circuit board 94 on which the circuit 88 is mounted. The circuit board 94 is also preferably formed of a printed circuit board material due to dimensional stability as well as dielectric characteristics and the like, the planes in which the respective boards 86 and 94 lie being essentially parallel to each other. The circuit board 94 carries various discrete circuit elements such as diodes 96 comprising a diode bridge, for example, and capacitors 98 to form a circuit which is conventional in the art. The capacitors 98 extend from the surface of the circuit board 94 upwardly through a cutout 100 formed in one edge of the board 86. The circuit board 94 further mounts along an inner edge thereof a spaced pair of plastic mechanical connectors 102 which hold the boards 86 and 94 in spaced relation to each other at least along respective aligned edges. Portions of the wiring 76 extend through apertures 104 and 106 to connect to the circuit 88 mounted by the circuit board 94.

A protective spacer element 108 effectively wraps the circuit board 94 to prevent inadvertent touching of the circuit 88, the element 108 protecting the circuit 88 and also protecting personnel who might inappropriately reach into the interior of the sign 40 without disconnection of power to the circuit 88. The protective spacer element 108 is provided with appropriate openings such as opening 110 to allow upper portions of the capacitors 98 to extend therethrough. The protective spacer element 108 is further formed with spaced tabs 112 formed along a front edge thereof, the tabs each having apertures 114 formed therein for connection to nubs 116 respectively formed in slots 118 disposed in spaced relation to each other and formed in the printed circuit board 86, the tabs 112 respectively extending into the slots 118 from beneath the board 86 with the apertures 114 engaging the nubs 116, the tabs 112 thus being held within the slots 118 thereby to hold the protective spacer element 108 in place and to facilitate maintenance of the printed circuit board 86 in an appropriate level disposition within the interior of the sign 40.

Corner mounts 120 formed on interior wall surfaces of the bottom wall 50 near each end of the wall 50 act to receive ends of the circuit board 94 and lowermost end portions of the protective spacer element 108 to facilitate a desired mounting not only of the board 94 but also of the board 86 on which the diodes 84 are mounted. The protective spacer element 108 is preferably formed of a dense paperboard such as is referred to in the industry as "fish paper". The fish paper material is light in weight, electrically insulative and rigid even though being a thin material.

Figure 7:
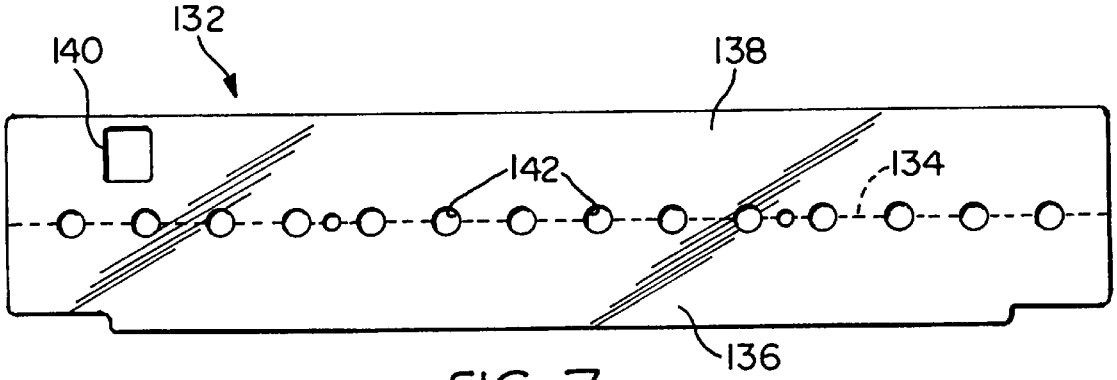
FIG. 7 is a planar view of a die-cut blank from which a preferred diffuser structure of the invention is formed.

The board 86 on which the light emitting diodes 84 are arrayed further mounts spaced posts 122 having split, compressible free ends 124 which allow snap-mounting of said ends 124 into openings 126 formed in spaced locations along ridge 128 of diffuser 130. The diffuser 130 is preferably formed from a blank 132 of a transparent, textured die-cut plastic film as is seen in FIG. 7 in the blank form, the texturing providing at least some degree of translucense to the diffuser 130. A preferred material is textured Lexan. The blank 132 is bent along a center line 134 to form the ridge 128 and to orient respective planar portions 136 and 138 at an angle relative to each other to form a dihedral angle. Openings such as the opening 140 can be stamped into the blank 132 so that devices (not shown) which can optionally be mounted on the board 86 can extend through said opening 140 if mounted to the board 86 at locations surmounted by such openings as the opening 140. Corners are rounded in order to prevent tearing of the material forming the diffuser 130. Ends of the planar portion 136 are preferably relieved as are the ends of the circuit board 86 in proximity to the relieved end portions of said planar portion 136 to allow communication into the interior of the diffuser 130 as necessary. Texturing of the material from which the diffuser 130 is formed allows a desired degree of diffusion of light striking interior surfaces of the planar portions 136, 138 of the diffuser 130 to diffuse light especially into lower portions of the enclosure of the exit sign 40 to facilitate illumination of lowermost portions of the legends 54 and 72.

Figure 4:
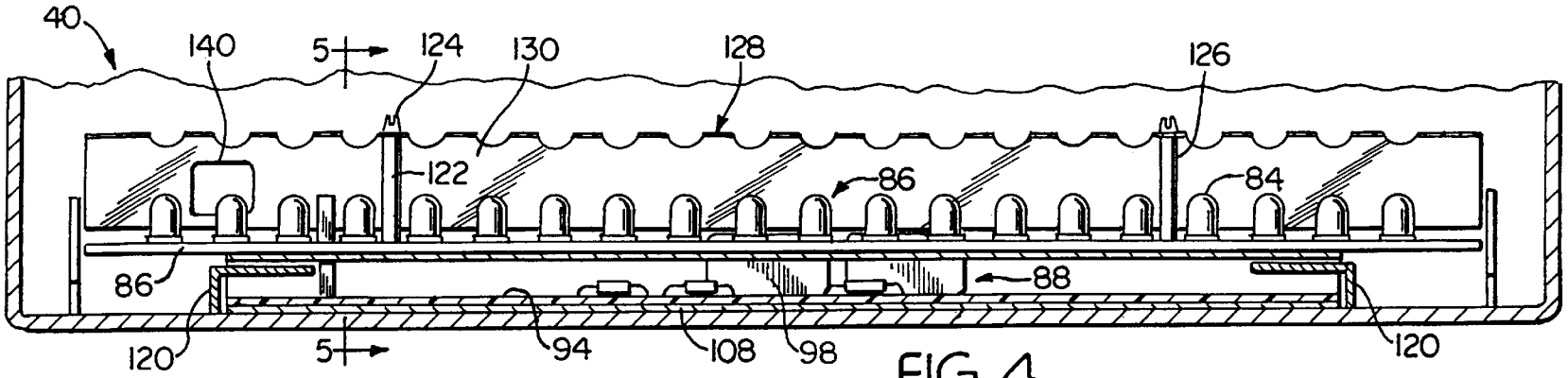
FIG. 4 is a side elevational view in section of the light emitting diode array and mounting arrangement surmounted by the preferred embodiment of the diffuser structure of the invention.
Figure 6:
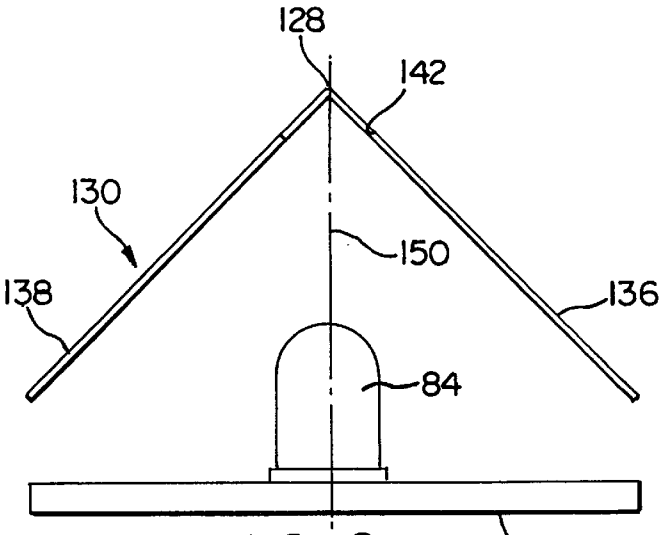
FIG. 6 is a schematic illustrating a preferred arrangement of a diffuser configured according to the invention and a light emitting diode.
Figure 5:
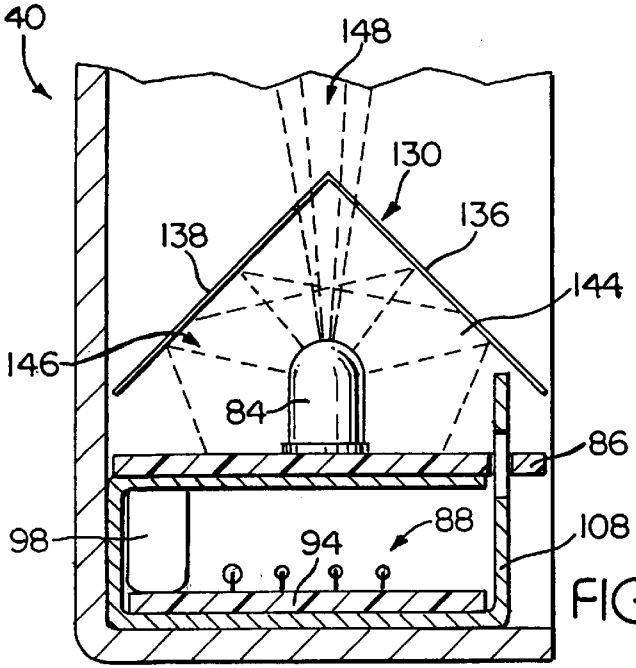
FIG. 5 is an end elevational view in section taken along lines 5—5 of FIG. 4.

In order to facilitate illumination of those portions of the interior of the exit sign 40 located more distantly from the array 82, spaced apertures 142 are formed in the ridge 128 of the diffuser 130, each of the apertures 142 being aligned with one each of the light emitting diodes 84 of the linear array 82. As is best seen in FIGS. 4, 5 and 6 substantial portions of the light emanating outwardly from free end portions of each of the diodes 84 pass undiffused through the apertures 142 to illuminate portions of the interior of the sign 40 spaced medially of the sign enclosure and more distantly from the array 82 such as those portions of the sign enclosure proximous to interior surfaces of the top wall 48 of the sign 40. As is particularly illustrated in FIG. 5, light emanating from the diodes 84 substantially within side angles 144 and 146 and light incident upon portions of the diffuser 130 about the periphery of each of the apertures 142 is diffused to respectively illuminate lowermost portions of the legends 54, 72 and at least portions of lower medial portions of the legends 54, 72. Substantial portions of the light emanating from free ends of the diodes 84 and essentially forming a top angle 148 or a "cone" of light pass through the apertures 142. However, at least portions of the light within this top angle 148 is incident on interior wall surfaces of the diffuser 130 and is diffused to facilitate illumination of portions of the interior of the sign 40 disposed more immediately above the light emitting diodes 84. Reflective surfaces disposed interiorly of the exit sign 40 as described herein cause internal reflection of both the diffused light passing through the diffuser 130 and the undiffused light passing through the apertures 142 to more evenly illuminate the interior of the exit sign 40 and to thereby more evenly illuminate the legends 54, 72 and further to provide a higher level of illumination generally through more efficient utilization of that light produced by the light emitting diodes 84. Therefore, the alternating zones of relatively dark and relatively bright illumination as seen in FIGS. 1A and 1B of the prior art do not exist in the exit sign 40 due primarily to the provision of the diffuser 130 in a surmounting relation to the diodes 84.

When the light emitting diodes 84 are chosen to be "blue" diodes, the sign panels 68, 70 are preferably chosen to be comprised of a fluorescing material such as a material manufactured into panels of appropriate thickness and referred to as a transformation material as is described in the aforesaid patent application which is incorporated hereinto by reference. As is described in this patent application which is assigned to the present assignee, the blue light emitted by the "blue" light emitting diodes causes the material forming the sign panels such as the sign panels 68, 70 to fluoresce and to produce an aesthetically acceptable green light through the legends 54, 72. The use of "green" light emitting diodes as the diodes 84 allows use of substantially conventional sign panels such as the sign panels 68, 70 which panels are conventionally formed of light diffusive material and which have a desired and conventional coloration.

Referring now particularly to FIG. 6, certain preferred relationships between each of the diodes 84 and the surmounting aperture 142 formed in the diffuser 130 can be best appreciated. As previously noted, the diode 84 is mounted to the board 86, the diode 84 being taken to be the "blue" light emitting diode described herein. In a preferred arrangement, the apexal ridge 128 of the diffuser 130 is located approximately 0.7 inch from the upper surface of the board 86 as measured along center line 150. The widths of each of the planar portions 136 and 138 are preferably taken to be approximately 1 inch, lowermost free edges of each of the planar portions 136 and 138 extending beyond respective edges of the board 86 and lying slightly above the plane of the board 86. The diameter of each of the apertures 142 is preferably approximately one-quarter inch. Although not seen in FIG. 6, the diameter of the apertures 126 are preferably taken to be approximately 0.15 inch. The dihedral angle of the diffuser 130 is typically approximately 90° with one-half of this angle lying to either side of the center line 150. It is to be understood, however, that the dihedral angle can vary over a substantial range while maintaining a desirable performance capability of the diffuser 130.

While the diode 84 which is particularly useful according to the invention is a "blue" light emitting diode manufactured by Nichia Chemical Industries, Ltd. of Tokyo, Japan, it is to be understood that light emitting diodes other than this particular diode find utility with the invention. The "blue" diode which finds particular utility is referred to as Nichia NLPB510 or Nichia NSPB510, these diodes having a nominal viewing angle of 30° with a typical luminous intensity of 350 mcd at 20 mA. The dominant wavelength is typically a minimum of approximately 463 to a maximum of approximately 485 nm at 20 mA. The height of this preferred diode 84 is approximately 0.326 inch above the upper surface of the board 86 as seen in FIG. 6 when mounted to said board 86.

Figure 10:
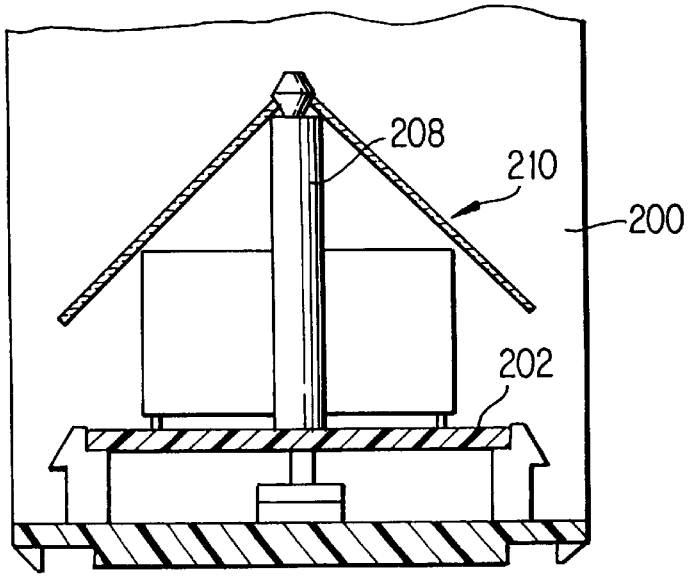
Figure 8:
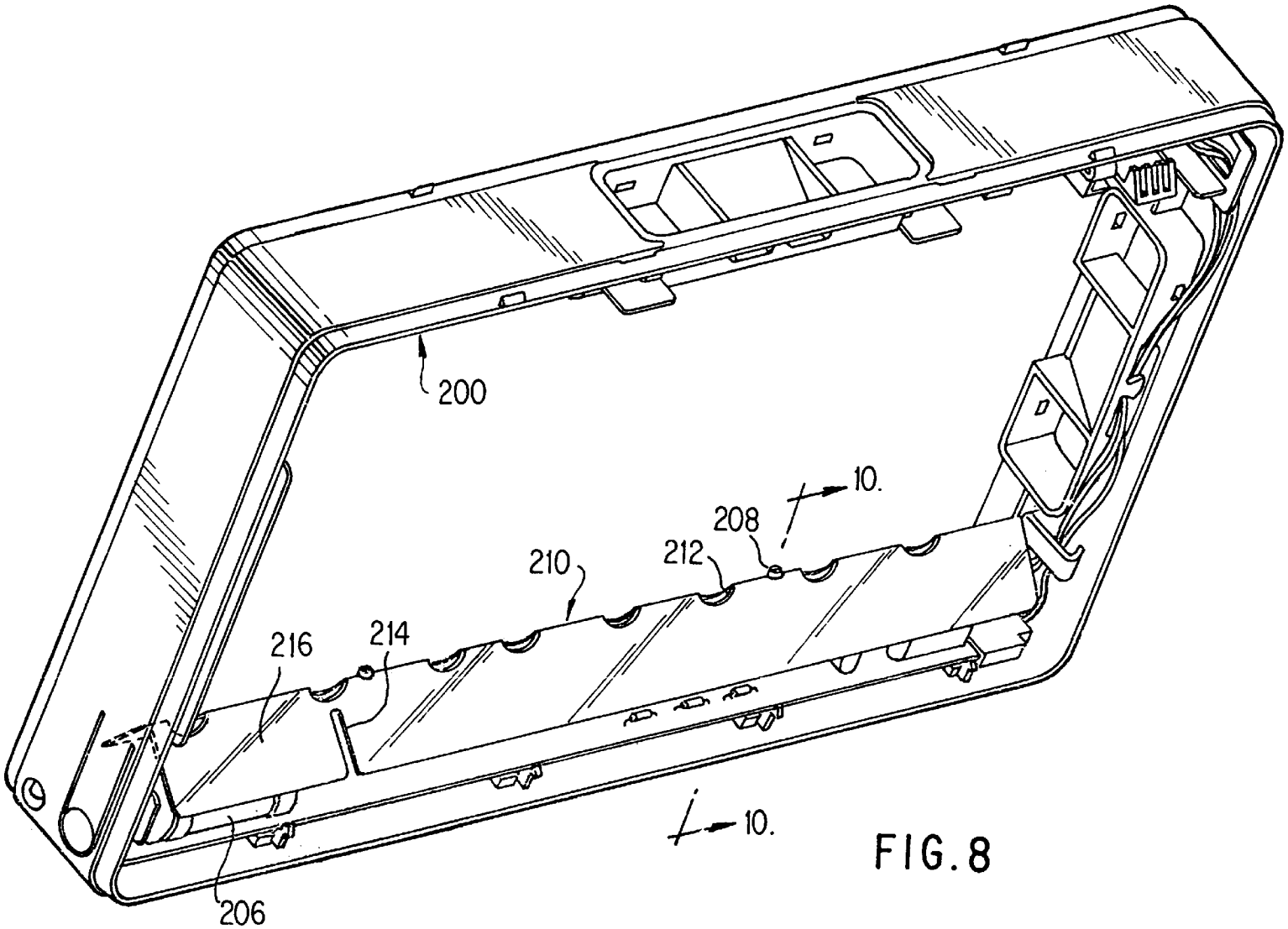
FIG. 8 is a perspective view of a substantially all-plastic exit sign having a diffuser configured according to another embodiment of the invention.
Figure 9:
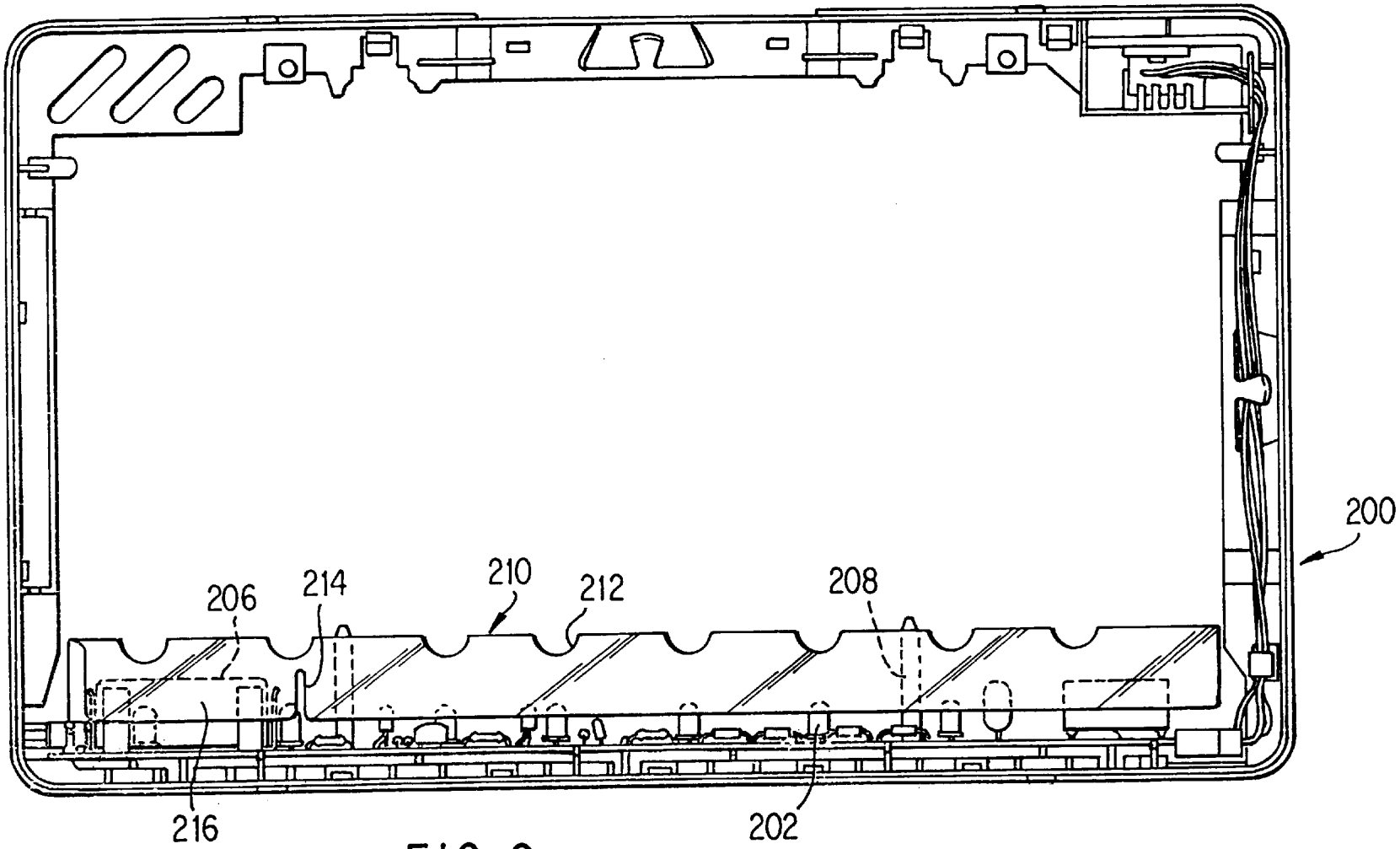
FIG. 9 is a front elevational view of the exit sign and diffuser of FIG. 8; and, FIG. 10 is a detail elevational view in section taken along lines 10—10 of FIG. 8.

Referring now to FIGS. 8 through 10, a frame 200 of an exit sign such as is described in copending U.S. patent application Ser. No. 08/850,494, filed of even date by Andrew Edward Masters and James Michael Lay and entitled "Housing Frame for Illuminated Signs having Multiple Configurations" and assigned to the same assignee, this patent application being incorporated hereinto by reference. The frame 200 is formed of a polymeric material as is disclosed in the aforesaid patent application and includes a circuit board 202 on which light emitting diodes 204 are mounted along with circuitry including battery 206. Posts 208 mounted by the circuit board 202 mount a diffuser 210 which is configured in a manner similarly to the diffuser 130 herein described. The diffuser 210 surmounts the circuit board 202 and an array of the light emitting diodes 204 spaced along said circuit board 202, the diffuser 210 having an aperture 212 disposed above each of the diodes 204. The diffuser 210 functions essentially in the same manner as described herein relative to the diffuser 130.

Since the structure shown in FIGS. 8 through 10 is intended to function as an "emergency" exit sign, that is, the battery 206 provides power to the light emitting diodes 204 on failure of AC mains power, the diffuser 210 is seen to be useful in other than "standard" exit signs and with exit signs formed of materials other than the particular material forming the housing of the exit sign 40 as described hereinabove. In the structure shown in FIGS. 8 through 10, the disposition of the battery 206 on the circuit board 202 typically requires the cutting of a slot 214 in the diffuser 210 to form flap 216, the flap 216 being capable of deforming upwardly and outwardly in order to accommodate the disposition of the battery 206 on the circuit board 202. While a cutout (not shown) could be utilized in the place of the flap 216 in order to accommodate the battery 206, the flap 216 functions to prevent light spillage while a cutout would not so function. For this reason, the same diffuser 210 having the flap 216 can be utilized for both standard and emergency versions of the exit sign in which the frame 200 is utilized as is shown in the patent application of Masters and Lay referred to herein.

It is to be understood that the diffusers 130 and 210 can be formed other than as explicitly shown and described herein. Further, the diffusers of the invention can be utilized with light emitting diodes of differing type such as diodes which are characterized as being of the diffuse, medium-viewing angle variety. Still further, the diffusers of the invention can be employed with light emitting diode arrays other than linear arrays such as the linear array 82 explicitly shown and described herein. Given the teachings provided herein, it is believed that alternative embodiments of the invention can be seen to follow from the explicit embodiments herein detailed, the scope of the invention being limited only by the recitations of the appended claims.

What is claimed is:

1. In an illuminated sign having at least one legend which is to be illuminated from interiorly of the sign for viewing of the legend from a location outside of the sign, the sign including a top wall, a bottom wall, side walls and planar face walls forming a sign enclosure, at least one of the face walls bearing the at least one legend, the interior of the sign enclosure being illuminated by an array of spaced apart point light sources disposed substantially along at least portions of internal wall surfaces of at least one of the top, bottom or side walls, the improvement comprising diffuser means disposed in surmounting relation to at least certain of the light sources for diffusing light incident onto surfaces thereof opposing said light sources and for passing such diffused light therethrough and into the interior of the sign enclosure, the diffuser means further having portions through which at least part of the light emanating from the light sources passes undiffused into the interior of the sign enclosure, the interior of the sign enclosure being thus evenly illuminated and thereby evenly illuminating the at least one legend.

2. In the illuminated sign of claim 1 wherein the point light sources comprise light emitting diodes.

3. In the illuminated sign of claim 2 wherein the light emitting diodes are relatively non-diffuse, narrow-viewing angle diodes.

4. In the illuminated sign of claim 2 wherein the light emitting diodes are disposed in a linear array.

5. In the illuminated sign of claim 2 wherein the light emitting diodes are disposed at locations opposing nearmost portions of the at least one legend.

6. In the illuminated sign of claim 2 wherein the portions of the diffuser means which act to pass light emanating from the light emitting diodes therethrough in an undiffused state comprises at least one opening in the diffuser means.

7. In the illuminated sign of claim 6 wherein each opening is aligned with and disposed in surmounting relation to one of the light emitting diodes.

8. In the illuminated sign of claim 7 wherein each opening comprises a substantially circular aperture.

9. In the illuminated sign of claim 8 wherein at least certain of the light emitting diodes produce a cone of light emanating from free ends thereof, the aperture surmounting each such light emitting diode being sized and spaced from the light emitting diode aligned therewith such that major portions of the light within the cone pass undiffused through the aperture, other portions of the light within the cone near defining surfaces of the cone being incident on inner wall surfaces of the diffuser means and being diffused through the diffuser means.

10. In the illuminated sign of claim 2 wherein the diffuser means comprise planar body portions joined at an apexal ridge, the body portions comprising a transparent, textured material capable of diffusing light incident thereon and passing the diffused light therethrough.

11. In the illuminated sign of claim 10 wherein at least one opening is formed in the apexal ridge, the opening being aligned with at least one of the light emitting diodes.

12. In the illuminated sign of claim 11 wherein each opening comprises a substantially circular aperture.

13. In the illuminated sign of claim 11 wherein the light emitting diodes are disposed in a linear array, the openings comprising a plurality of substantially circular apertures aligned one each with each of the light emitting diodes.

14. In the illuminated sign of claim 2 and further comprising means for mounting the light emitting diodes in a predetermined location within the interior of the exit sign enclosure and for maintaining the light emitting diodes in a fixed location therewithin.

15. In the illuminated sign of claim 14 wherein the mounting and maintaining means comprise a first substrate on which the light emitting diodes are mounted in an electrical circuit, a second substrate carrying circuit elements and being surmounted by the first substrate, means for interconnecting the substrates electrically, and means for interconnecting the substrates mechanically.

16. In the illuminated sign of claim 15 wherein the mechanical interconnecting means comprise a dielectric wrapper encompassing the second substrate and acting to protect the circuit elements on said substrate, the wrapper having means formed therewith for engaging the first substrate.

17. In the illuminated sign of claim 16 wherein the exit sign has mounting means disposed on an interior wall and defining a recess for receiving at least portions of the second substrate and portions of the wrapper to hold portions of the wrapper and of the second substrate in relation to the interior wall, the engaging means formed on the wrapper acting to maintain the first substrate in a location near to and spaced from the interior wall.

18. In the illuminated sign of claim 16 wherein the mechanical interconnecting means further comprise mounting posts interconnecting the first and second substrates and extending therebetween for connection to each of said substrates.

19. A diffuser useful in an illuminated sign which is illuminated by a plurality of point light sources comprising light emitting diodes disposed substantially along at least portions of internal wall surfaces of the sign, comprising:

a body member formed of a material capable of diffusing light incident thereon and passing the diffused light through the body member; and, means formed on the body member for passing light through the body member in an undiffused condition comprising openings formed in the body member in a predetermined relation to the light emitting diodes to pass substantial portions of the light emanating from the light emitting diodes through the body member in an undiffused condition.

* * * * *